US009038289B2

(12) United States Patent
Kelly

(10) Patent No.: US 9,038,289 B2
(45) **Date of Patent: *May 26, 2015**

(54) AUTOMATED BLADE WITH LOAD MANAGEMENT CONTROL

(71) Applicant: Deere & Company, Moline, IL (US)

(72) Inventor: Andrew Wayne Kelly, Sherrill, IA (US)

(73) Assignee: Deere & Company, Moline, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/281,526

(22) Filed: May 19, 2014

(65) Prior Publication Data

US 2014/0277966 A1 Sep. 18, 2014

Related U.S. Application Data

(63) Continuation of application No. 11/565,408, filed on Nov. 30, 2006, now Pat. No. 8,726,543.

(51) Int. Cl.

| | |
|---|---|
| ***E02F 3/04*** | (2006.01) |
| ***E02F 9/20*** | (2006.01) |
| ***E02F 3/84*** | (2006.01) |

(52) U.S. Cl.

CPC ..... *E02F 9/2029* (2013.01); *E02F 3/847* (2013.01)

(58) Field of Classification Search

CPC ..... E02F 9/2029; E02F 3/847
USPC ..... 37/412–415; 172/2; 701/50, 84, 87
See application file for complete search history.

(56) References Cited

U.S. PATENT DOCUMENTS

| | | | | | |
|---|---|---|---|---|---|
| 3,782,572 | A | * | 1/1974 | Gautier | 414/699 |
| 4,086,563 | A | * | 4/1978 | Bachman | 340/439 |
| 4,518,044 | A | * | 5/1985 | Wiegardt et al. | 172/7 |
| 4,846,283 | A | * | 7/1989 | Batcheller | 172/10 |
| 5,009,294 | A | * | 4/1991 | Ghoneim | 477/185 |
| 5,047,940 | A | * | 9/1991 | Onaka et al. | 701/87 |
| 5,082,081 | A | * | 1/1992 | Tsuyama et al. | 180/197 |
| 5,462,125 | A | | 10/1995 | Stratton et al. | |
| 5,555,942 | A | * | 9/1996 | Matsushita et al. | 172/3 |
| 5,564,507 | A | * | 10/1996 | Matsushita et al. | 172/3 |
| 5,684,691 | A | * | 11/1997 | Orbach et al. | 700/56 |
| 5,699,248 | A | | 12/1997 | Nakagami et al. | |
| 5,755,291 | A | * | 5/1998 | Orbach et al. | 172/2 |
| 5,819,190 | A | * | 10/1998 | Nakagami et al. | 701/50 |
| 5,911,769 | A | * | 6/1999 | Orbach et al. | 701/50 |
| 6,035,249 | A | | 3/2000 | Yamamoto et al. | |

(Continued)

FOREIGN PATENT DOCUMENTS

| | | | | |
|---|---|---|---|---|
| JP | S57119028 A | | 7/1982 | |
| WO | WO 2005042951 A1 | * | 5/2005 | F02D 29/00 |

OTHER PUBLICATIONS

Grandia, Curt, Pioneering GPS for Site Prep McAninch Uses Global Positioning to Increase Efficienceis, Projected value, Midwest Contractor Serving Nebraska, Iowa, Kansas, and Western Missouri, Aug. 26, 2002.

(Continued)

*Primary Examiner* — Matthew Buck
(74) *Attorney, Agent, or Firm* — Faegre Baker Daniels LLP

(57) ABSTRACT

There is here disclosed an excavation machine having an automatic controlled excavation implement that adjusts the excavation implement to maximize the earth moved in accordance with vehicle operating parameters, and finished terrain parameters.

21 Claims, 2 Drawing Sheets

(56) References Cited

U.S. PATENT DOCUMENTS

| | | | | |
|---|---|---|---|---|
| 6,052,647 | A * | 4/2000 | Parkinson et al. | 701/23 |
| 6,064,933 | A * | 5/2000 | Rocke | 701/50 |
| 6,216,072 | B1 * | 4/2001 | Boe et al. | 701/50 |
| 6,234,254 | B1 * | 5/2001 | Dietz et al. | 172/3 |
| 6,269,885 | B1 * | 8/2001 | Barber et al. | 172/7 |
| 6,317,676 | B1 * | 11/2001 | Gengler et al. | 701/82 |
| 6,385,519 | B2 * | 5/2002 | Rocke | 701/50 |
| 6,547,012 | B2 * | 4/2003 | Scarlett et al. | 172/1 |
| 6,655,465 | B2 * | 12/2003 | Carlson et al. | 172/4.5 |
| 6,879,899 | B2 * | 4/2005 | Budde | 701/50 |
| 6,954,999 | B1 * | 10/2005 | Richardson et al. | 37/348 |
| 7,121,355 | B2 * | 10/2006 | Lumpkins et al. | 172/4.5 |
| 7,293,376 | B2 * | 11/2007 | Glover | 37/414 |
| 7,555,855 | B2 * | 7/2009 | Alshaer et al. | 37/382 |
| 8,145,391 | B2 | 3/2012 | Omelchenko et al. | |
| 8,352,132 | B2 | 1/2013 | Omelchenko et al. | |
| 8,473,166 | B2 | 6/2013 | Zhdanov et al. | |
| 8,726,543 | B2 * | 5/2014 | Kelly | 37/412 |
| 2004/0117092 | A1 * | 6/2004 | Budde | 701/50 |

OTHER PUBLICATIONS

Sitek, Greg, Define Site Prep-Site Prep Can Mean Different Things to Different People. Essentially it Means Getting Ready to Make a Profit, Midwest Contractor, Aug. 26, 2002.

Welch, Brian, 3-D Systems Save Prep Time Robotic Technology Saves Time and Money on Road Projects, Construction News Serving Arkansas, Oklahoma, Western Tennessee, Louisiana, and Mississippi, Aug. 19, 2002.

Fisher, Christina, The Success of the Conway Bypass, Innovative Techniques, New Technology and Cooperation all Contributed to the Successful Debut of the Conway Bypass, Which Opened Seven Months Ahead of Schedule, Construction Serving North Carolina, South Carolina, Virginia, Maryland and Washington D.C. Building the Conway Bpyass, Aug. 13, 2001.

Gantenbein, Barry, Raising the Bar River View Construction, Inc. uses GPS System to Work Faster, More Accurately, Western Builder Building & Engineering Construction News of Wisconsin and Upper Michigan, Aug. 15, 2002, 92$^{nd}$ Year No. 33.

* cited by examiner

AUTOMATED BLADE WITH LOAD MANAGEMENT CONTROL

CROSS REFERENCE TO RELATED APPLICATION

This application is a continuation of U.S. patent application Ser. No. 11/565,408, filed Nov. 30, 2006, the disclosure of which is hereby expressly incorporated by reference herein in its entirety.

BACKGROUND OF THE INVENTION

The invention disclosed and claimed hereafter relates to mechanical earth excavation equipment exemplified by a motorized grader. More specifically, the invention relates to controlling the position of the scraping blade or bucket of such equipment with respect to the location on the surface of the earth and with respect to the desired finished grade of the earth.

SUMMARY OF THE INVENTION

The instant disclosed and claimed invention is directed to optimizing the work accomplished by the earth moving equipment in the preparation of a predetermined earth contour. The invention provides a savings of time, and energy required to accomplish the desired earth contour. Global Positioning Systems (GPS) available for civilian use may locate the position of the of the excavation equipment on the planet. In addition, the GPS may also provide the elevation of the equipment at a position on the planet. Together the position and elevation data constitute the earth contour desired for a given project such as a highway, parking lot, etc.

This invention combines the desired contour with equipment operations data to optimize the excavation.

According to an exemplary embodiment of the present disclosure, an excavation machine is provided including an excavation implement, at least one ground engaging traction device, an engine capable of providing an engine output to the at least one ground engaging traction device, the engine having an optimum efficiency range, and a controller configured to determine whether the engine is operating within the optimum efficiency range and to automatically control the position of the excavation implement based on the determination of whether the engine is operating within the optimum efficiency range.

According to another exemplary embodiment of the present disclosure, an excavation machine is provided including an excavation implement, at least one ground engaging traction device, an engine capable of providing an engine output to the at least one ground engaging traction device, a global positioning receiver for determining a location of the excavation machine, and a controller that combines the location of the excavation machine from the global positioning receiver with a finished earth contour depth to automatically lower the excavation implement by a programmed increment when the excavation implement is located above the finished earth contour depth.

According to yet another exemplary embodiment of the present disclosure, an excavation machine is provided including an excavation implement, at least one ground engaging traction device, an engine capable of providing an engine output to the at least one ground engaging traction device, and a controller configured to determine whether the engine has excess power available and to automatically control the position of the excavation implement based on the determination of whether the engine has excess power available.

DESCRIPTION OF INVENTION

The availability of GPS information for civilian use has resulted in incorporation of location and elevation data in construction plans. Heavy equipment such as graders, scrapers, bull dozers, compactors, excavators and similar earthworks construction machines also incorporates sensors and controllers that monitor and adjust the equipment operation such as engine speed, and engine efficiency. The combination of GPS and wheel rotation (or in the case of a crawler type vehicle, track travel) informs the controller through an appropriate algorithm of the wheel (or track) slippage. As a simplified description of the instant invention, traditionally, when an equipment operator noticed wheel slippage, the operator could respond by raising the excavating implement, which could be a scraping blade, a bucket, or a plow, or a chisel, or ripping teeth, or a similar excavation implement. Hereafter the excavation implement, which may be described hereafter as a blade, could be located at the front of the equipment, such as a bulldozer, or mounted amidships as in the illustrated motor-grader or mounted at the rear of a vehicle as is often the case for 'ripper' teeth. Raising the blade reduces the resistance to movement of the equipment which in turn enables the equipment to regain traction to move, without wheel slippage, and the now reduced volume of earth being pushed by the now raised blade.

In the presently disclosed and claimed invention, the controller combines the input from the GPS, the desired earth contour, and equipment operation to adjust the blade depth without operator input. This automatic feature affords several benefits including: more rapid response than human response, the opportunity to adjust optimum power output/engine efficiency to blade depth by way of integration of engine performance algorithms with wheel slip and blade depth response, reduced operator fatigue, lower fuel costs and reduced equipment maintenance resulting from fewer overloads on equipment.

Figure 1:
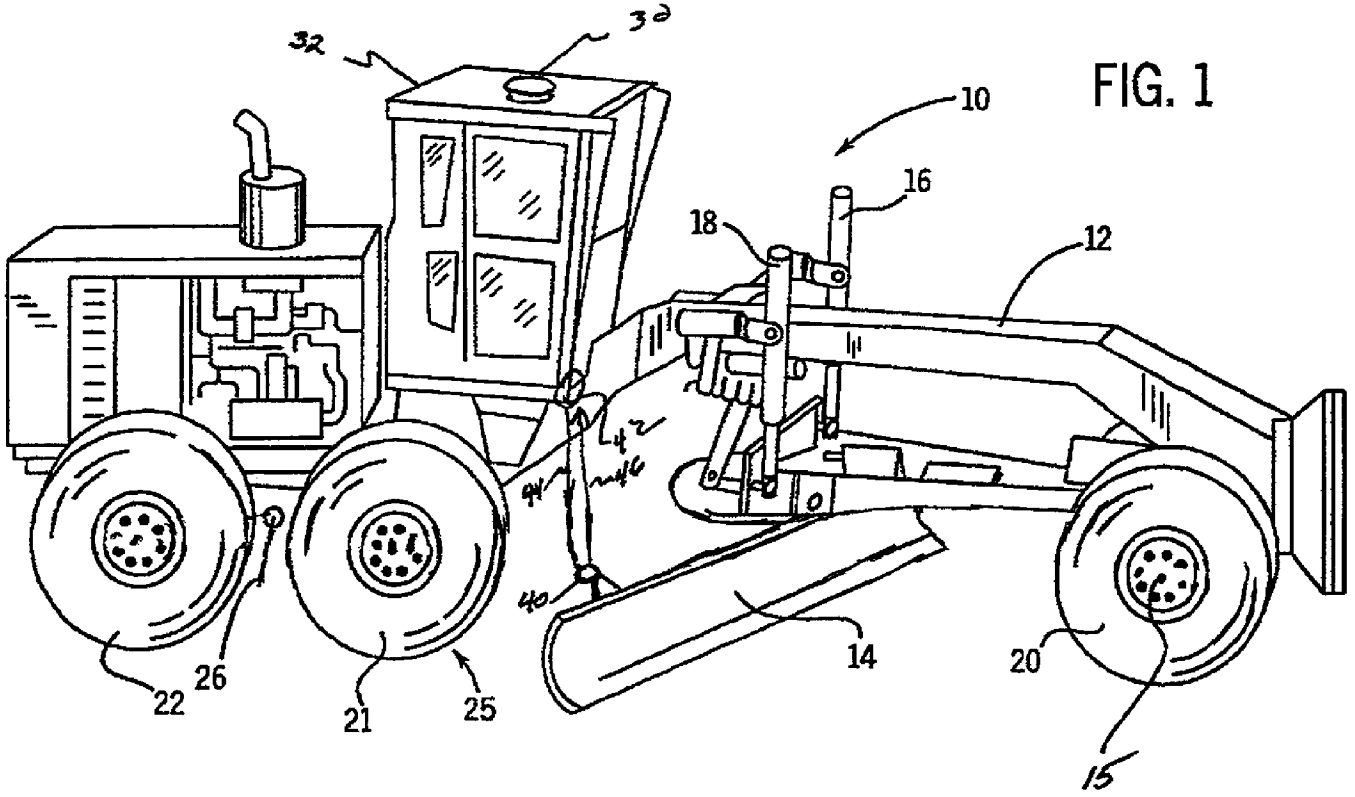
FIG. 1 discloses a typical motor-grader.

FIG. 1 shows a motorized grader 10 which, for purposes of the instant invention, is illustrative of heavy equipment to which the instant invention is applicable. The grader 10 has a frame 12 extending the length of the grader 10 with a blade 14 mounted in or toward the middle of the distance between the front axle 15 having attached thereto wheel and tire 20 and the hinge point 26 of the rear tandem wheel assembly 25 including wheels and tires 21, 22.

A global positioning receiver 30 provides data on the location of the receiver 30 on the earth's surface, and the altitude of the receiver 30. The global positioning receiver 30 is shown on the cab 32 of the grader 10. The receiver 30 interfaces with the controller, not shown. Also input to the controller is the blade position. The blade 14 may be raised and lowered by hydraulic cylinders 16, 18 attached to the grader frame 12 and to the blade 14. The blade position may be determined by measurement with a laser measurement from a reflector 40 on the blade to a laser beam generator and receiver 42. Whereby the time delay from the laser output signal 44 to the return signal 46, associated with appropriate trigonometry, dimensions of the grader 10, and an algorithm enable a controller to locate the elevation of the blade 14 with respect to the elevation of the grader wheels 20, 21, 22 on the earth's surface. A secondary measurement of the blade position may be derived from measurement of the volume of hydraulic fluid in each hydraulic fluid in the cylinders 16, 18. Alternatively, if the grader 10 is equipped with preferred electro-hydraulically controlled cylinders, the algorithm controlling the blade position may be interfaced with the controller to provide the controller with specific data concerning the blade location with respect to the surface of the earth as reflected by the position of the grader tires 20, 21, 22.

Global positioning equipment finding utility in the excavation/earth contouring industry may have location accuracy within 3 cm (1.2 inches). Advanced GPS systems incorporation position correction algorithms, interference correction now finding application in the excavation/earth contouring industry claim accuracy location within 5 mm (0.2 inch). Such systems are publicly offered by sources such as Trimble Navigation Limited, 935 Stewart Avenue, Sunnyvale, Calif., 94085, USA. (www.trimble.com)

If the depth of the blade 14 into the earth causes resistance in excess of the vehicle traction, but not the power available to the vehicle, the wheels 20, 21, 22 will spin or slip. When wheel-slip occurs the engine is turning the wheels 20, 21, 22 but the grader 10 is moving at less than the distance that it would move if there were no slippage at the interface of the wheels with the earth. Wheel-slip consumes time and energy, but does not accomplish work.

Wheel-slip may be determined by the controller by comparing the distance the grader 10 would move if there were no wheel-slip with the actual position dislocation as determined by GPS.

In a manual mode of operation of excavation machines as has been heretofore employed the vehicle operator is required to determine implement depth, engine torque availability, torque optimization through the transmission and wheel slip. The equipment operator initiated machine movement engagement of the implement to the earth, engine speed and transmission gearing. The operator may, for example, direct the tool depth in the earth sufficient to exceed vehicle traction resulting in wheel-slip. Upon noticing wheel rotation without corresponding vehicle movement, the operator may adjust implement depth in the earth. While operator attention to wheel-slip has served the earth grading industry well, operator fatigue and earth grading efficiency may be improved by a means to detect and correct for wheel-slip that does not require operator attention.

According to the instant invention, when available torque applied to the vehicle wheels exceeds the force the wheels can transmit to the ground, the system disclosed herein detects wheel-slip, whereupon, the controller directs that the resistance to vehicle movement be reduced by raising the implement.

Turning to the condition where the implement engagement with the earth does not result in vehicle wheel-slip, the controller may direct the implement further into the earth. When the implement engages the earth further, two conditions may result: 1) if as in the circumstance above, the torque applied to the wheels exceeds the force the wheels can transmit to the ground, or 2) the engine output torque may not produce sufficient torque to cause wheel-slip. In the first instance, the controller would then raise incrementally the implement in response wheel-slip, as described above. A second possible result is that vehicle torque output may be increased. In such event, the controller may determine the engine has additional power available within an efficient operating range. Further, the controller may determine if the transmission has available a gear setting having greater torque output. If additional engine power is available, or a lower transmission gear is available, then the controller may provide a signal resulting in additional torque output from the engine, or a transmission adjustment or a combination engine and transmission adjustments. If available adjustments to engine and transmission do not result in wheel-slip, and the engine is operating in an optimum range, then the controller may direct that the implement be lowered to a still further depth that initiates wheel-slip. If available adjustments to engine and transmission do not result in wheel slip, and the engine is operating at the edge of the acceptable operating envelope further engine transmission adjustments are not within a range of acceptable engine efficiency, then the controller will initiate a signal to cause the blade to be incrementally raised until the engine operation returns within the envelope of acceptable engine efficiency.

Figure 2:
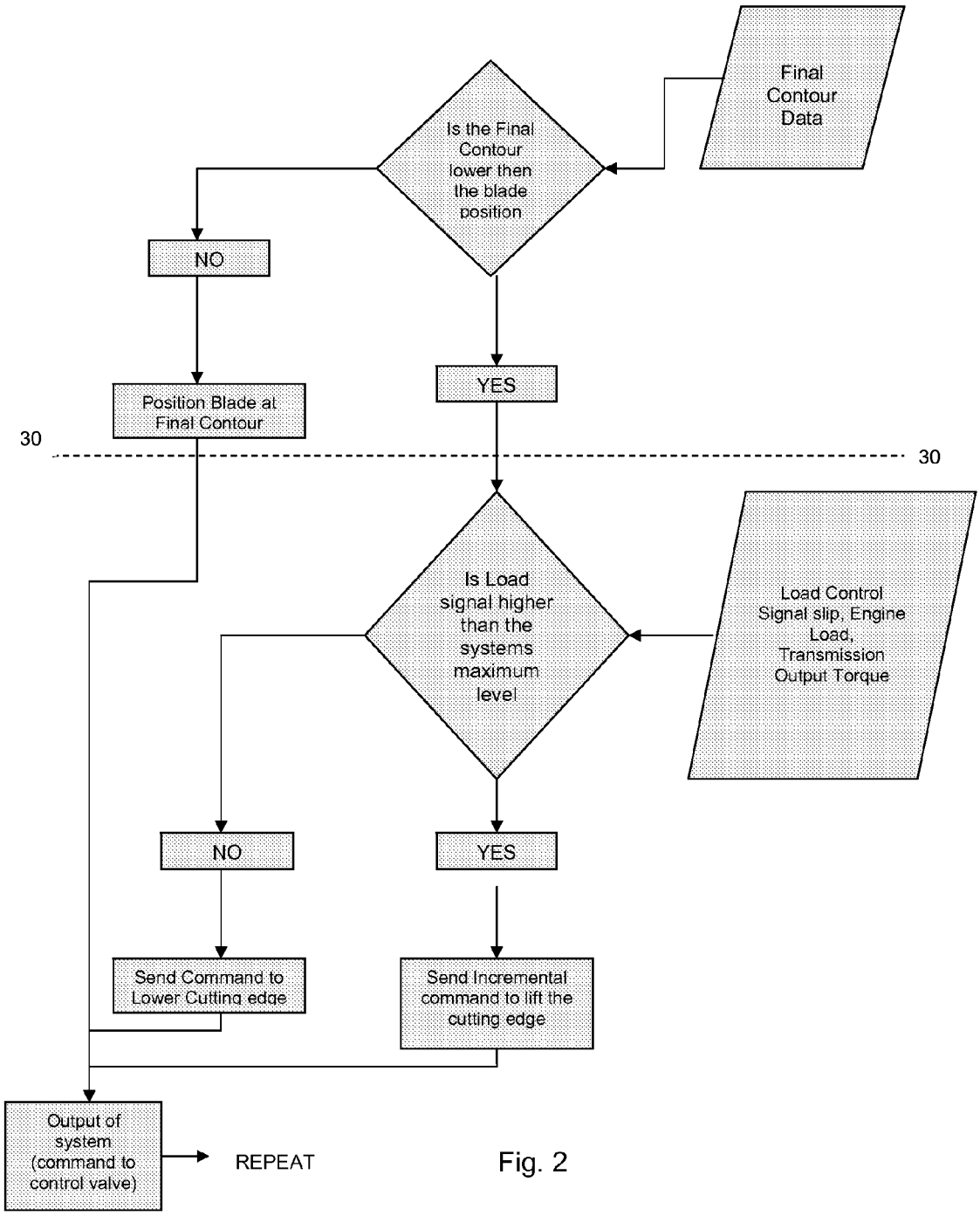
FIG. 2 diagrams a program decision tree for an algorithm implementing the instant invention.

As is customary, the foregoing decision tree may be evaluated by the vehicle controller many times per minute, with appropriate adjustments. FIG. 2 is an illustration of a decision tree that may be programmed into the memory of the vehicle controller. As used herein, a vehicle controller may be one or more integrated circuit devices, including those on one or more microchips that monitor the functions of vehicle engine, transmission, implement position, vehicle position and generate outputs that cause a change of the status of the vehicle engine, transmission, implement position, vehicle position pursuant to preprogrammed algorithms and data input. The vehicle controller includes the capacity to receive, store, and access earth contour data as established by a site plan.

The portion of the decision tree below line 30 that makes use of the automated wheel-slip control and maximizes available torque to the wheels from the vehicle engine may be utilized independent of vehicle position data.

Above line 30 FIG. 2 illustrates controller decisions that incorporate the wheel-slip feature and the maximization of available torque and in addition limit the depth of the excavation to the final earth contour to the contour established by a site plan and downloaded to the vehicle controller.

The utilization of automated implement depth control can further enhance vehicle efficiency when combined with topographical data of the finished grade of the job site necessary to describe the parameters of the surface of the earth representing a completion of the excavation. By looping to include topographical data according to FIG. 2, the algorithm may limit the implement (such as a grader blade) from lowering the blade below the maximum depth of the finished earth contour thereby providing an accurate earth contour without cutting too deep necessitating backfilling and sometimes compaction, or requiring the assistance of an on site surveyor to continually check the grade with the desired final earth contour.

In operation, the controller signals adjustment of blade position by the interface of data of the power delivered to the wheels to advance the grader that either does not result in wheel-slip, or if wheel-slip result is permitted, that wheel slip is reduced to exceed a permitted maximum. The algorithms of the controller may rapidly determine wheel-slip from a comparison of changes of GPS position which are less than the maximum distance expected from the wheel rotation. When wheel-slip occurs, the controller re-directs the electro-hydraulic cylinders 16, and 18 to raise the blade by a programmed increment. The controller may then repeat the program loop. If the wheel-slip condition continues, then the blade is again raised by a programmed increment. The controller repeats the loop until the wheel-slip condition is no longer indicated by the comparison in the change of GPS position compared with the expected travel distance from drive wheel rotation.

Accomplished work is maximized by operating the engine in a range of optimized performance and adjusting the blade height to move the maximum volume of earth. If the controller determines that additional work may be accomplished by the engine within an optimized performance range, and that wheel-slip is not occurring, then the controller may direct that the blade be lowered by a programmed increment to increase the volume of earth moved. If wheel-slip does not result from the lowered blade, the loop may be repeated.

The correspondence of wheel-slip to actual change in position may require calibration from time-to-time to account for: tire wear which reduces the tire circumference and correspondingly the distance traveled per wheel rotation, or tire pressure, which may be raised or lowered to accommodate terrain conditions, a change in the type of tire with which the vehicle is equipped such as the addition of a 'flotation' tire to accommodate terrain conditions, or tire/wheel circumference may temporarily increase as by a sticky clay type soil adhering to the tires. Calibration may be quickly accomplished by appropriate algorithm and operator interface while the vehicle is moving without resistance from the excavation implement.

From the foregoing description it may be learned that the controller may maximize the volume of work accomplished by adjusting the blade height, engine torque output and transmission gearing. The foregoing description assumes that the grader has available, and is operating at a rate of, power sufficient to cause wheel-spin rather than stall the grader engine. The controller may also direct the blade height position under conditions where wheel-slip does not occur, i.e., the power at the wheels does not exceed the vehicle traction. The controller may also adjust the blade height in response to engine power output selected by the operator. If the engine revolutions per minute drops below the operating limit programmed for the controller, then as in the case of wheel-slip, the controller may direct that the blade be raised by a programmed amount. Alternatively, or in combination, the controller may direct that the power train shift to a lower gear to provide more mechanical advantage to the engine. If the engine revolutions continue below the programmed operating limit, then the controller may repeat the command to raise the blade and/or shift to a lower gear.

Alternatively, as in the case of power available in excess of that necessary to cause wheel-slip, the controller may direct that the blade be lowered by a programmed increment to increase the volume of earth moved to the maximum at the rate of power available.

An effective algorithm for the controller also permits the operator to override the automated system to manually operate the vehicle, the engine and blade.

Vehicle axis describes the forward/rearward direction of travel while turning neither left nor right. Blade angle describes the movement of a blade from the position perpendicular to the vehicle axis whereby an end of the blade is moved forward or rearward to an angle other than perpendicular to the vehicle axis. Blade pitch may be described as movement of the top edge of the blade generally along the vehicle axis forward and rearward with respect to the lower blade edge so as to change the angle at which the blade intersects level ground. Some blades are contoured in a concave shape as viewed from the front of the vehicle. The blade-ground angle of intersection in the case of curved blades in such instance would relate to the angle created by the intersection of a tangent to the curve of the blade with level ground. Blade tilt involves raising, or lowering, one end of the blade relative to the opposite end. A tilted blade digs deeper into the earth on one side of the vehicle axis than on the other.

The blade functions of blade tilt, blade angle, and blade pitch may also be adjusted by a controller appropriately programmed according afore described feedback loop scheme.

As is evident from the foregoing description, the operation of an earth contouring vehicle may be simplified by the automated control system. Skilled operators may utilize the system as desired. Operators having lower skill level may effectively and efficiently operate an earth contouring vehicle without overloading the vehicle drive train by reliance upon the automated system.

What is claimed is:

1. An excavation machine including:

an excavation implement;

at least one ground engaging traction device;

an engine capable of providing an engine output to the at least one ground engaging traction device, the engine having an optimum efficiency range; and a controller configured to determine whether the engine is operating within the optimum efficiency range and to automatically control the position of the excavation implement based on the determination of whether the engine is operating within the optimum efficiency range.

2. The excavation machine of claim 1, further including a transmission configured to provide a torque force to the ground engaging traction device by transferring the engine output to the ground engaging traction device, wherein the controller is configured to automatically control the torque force provided by the transmission to the at least one ground engaging traction device based on the determination of whether the engine is operating within the optimum efficiency range.

3. The excavation machine of claim 2, wherein the controller responds to a slippage of the at least one ground engaging traction device by adjusting the transmission to a lower gear setting.

4. The excavation machine of claim 1, wherein the controller is configured to automatically control the engine output based on the determination of whether the engine is operating within the optimum efficiency range.

5. The excavation machine of claim 4, wherein the controller responds to a slippage of the at least one ground engaging traction device by increasing a torque of the engine output.

6. The excavation machine of claim 1, wherein the controller lowers the excavation implement when the controller determines that the engine is operating within the optimum efficiency range.

7. The excavation machine of claim 1, wherein the controller lowers the excavation implement until a slippage of the ground engaging traction device.

8. The excavation machine of claim 1, wherein the controller limits the excavation implement from being lowered beneath a finished earth contour depth.

9. The excavation machine of claim 1, wherein the controller raises the excavation implement when the controller determines that the engine is operating below the optimum efficiency range.

10. The excavation machine of claim 1, wherein the excavation machine includes one of a grader, a scraper, a bull dozer, a compactor, and an excavator.

11. The excavation machine of claim 1, wherein the excavation implement includes one of a blade, a bucket, a plow, a chisel, and ripping teeth.

12. An excavation machine including:

an excavation implement;

at least one ground engaging traction device;

an engine capable of providing an engine output to the at least one ground engaging traction device;

a global positioning receiver for determining a location of the excavation machine; and a controller that combines the location of the excavation machine from the global positioning receiver with a finished earth contour depth to automatically lower the excavation implement by a programmed increment when the excavation implement is located above the finished earth contour depth.

13. The excavation machine of claim 12, wherein the controller repeatedly lowers the excavation implement by the programmed increment as long as the excavation implement is located above the finished earth contour depth.

14. The excavation machine of claim 12, wherein the controller lowers the excavation implement when the location of the excavation machine from the global positioning receiver equals an expected location of the excavation machine.

15. The excavation machine of claim 12, wherein the controller raises the excavation implement when the location of the excavation machine from the global positioning receiver differs from an expected location of the excavation machine.

16. The excavation machine of claim 12, further including a transmission configured to transfer the engine output to the ground engaging traction device, wherein the controller lowers a gear setting of the transmission when the location of the excavation machine from the global positioning receiver differs from an expected location of the excavation machine.

17. The excavation machine of claim 12, wherein the controller increases a torque of the engine output when the location of the excavation machine from the global positioning receiver differs from an expected location of the excavation machine.

18. An excavation machine including:

an excavation implement;

at least one ground engaging traction device;

an engine capable of providing an engine output to the at least one ground engaging traction device; and a controller configured to determine whether the engine has excess power available and to automatically control the position of the excavation implement based on the determination of whether the engine has excess power available.

19. The excavation machine of claim 18, wherein the controller lowers the excavation implement to move a maximum volume of earth based on the power available from the engine.

20. The excavation machine of claim 18, wherein the controller lowers the excavation implement until a slippage of the ground engaging traction device.

21. The excavation machine of claim 18, wherein the controller repeatedly lowers the excavation implement by programmed increments until reaching a finished earth contour depth.

* * * * *

UNITED STATES PATENT AND TRADEMARK OFFICE

CERTIFICATE OF CORRECTION

PATENT NO. : 9,038,289 B2
APPLICATION NO. : 14/281526
DATED : May 26, 2015
INVENTOR(S) : Andrew Wayne Kelly It is certified that error appears in the above-identified patent and that said Letters Patent is hereby corrected as shown below:

On the title page

In Figure 1, reference numeral 32 should be corrected to read --30--

In the drawings

In Figure 2, the flow box at the top-center of the figure should read --Is the Final Contour Lower than the blade position--

Signed and Sealed this
Twenty-second Day of March, 2016

Michelle K. Lee

Michelle K. Lee
*Director of the United States Patent and Trademark Office*